US007031639B2

(12) United States Patent
Masuda et al.

(10) Patent No.: US 7,031,639 B2
(45) Date of Patent: Apr. 18, 2006

(54) OPEN/CLOSE MECHANISM AND IMAGE FORMING APPARATUS USING THE SAME

(75) Inventors: Junya Masuda, Ikoma (JP); Tatsuya Inoue, Nara (JP); Yoshiharu Yoneda, Nara (JP); Shinji Nakazawa, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/843,504

(22) Filed: May 12, 2004

(65) Prior Publication Data

US 2004/0237690 A1 Dec. 2, 2004

(30) Foreign Application Priority Data

May 13, 2003 (JP) ..... 2003-134010

(51) Int. Cl.
*G03G 21/00* (2006.01)

(52) U.S. Cl. ..... 399/124

(58) Field of Classification Search ..... 399/124; 74/469

See application file for complete search history.

(56) References Cited

U.S. PATENT DOCUMENTS

2004/0175210 A1* 9/2004 Otaka ..... 399/318

FOREIGN PATENT DOCUMENTS

| | | | |
|---|---|---|---|
| JP | 60114869 A | * | 6/1985 |
| JP | 11-24534 A | | 1/1999 |
| JP | 2000-191163 A | | 7/2000 |

* cited by examiner

*Primary Examiner*—Quana Grainger
(74) *Attorney, Agent, or Firm*—Birch, Stewart, Kolasch & Birch, LLP

(57) ABSTRACT

A link member interlinks an external member forming part of a cabinet of an apparatus and an internal member capable of pivoting about a pivot shaft located more deeply inside the apparatus than the external member for causing the internal member to pivot in cooperation with the external member pivoting. The link member has a stretchable length and is provided with a resilient biasing member biasing the link member in such a direction as to stretch the length. When the external member is in its closed position, the internal member is positioned to abut a predetermined contact portion by the biasing force of the resilient biasing member. Parts storage shelves are provided in the space defined between the external member and the internal member.

12 Claims, 7 Drawing Sheets

OPEN/CLOSE MECHANISM AND IMAGE FORMING APPARATUS USING THE SAME

CROSS REFERENCE

This Nonprovisional application claims priority under 35 U.S.C. § 119(a) on Patent Application Ser. No. 2003-134010 filed in Japan on May 13, 2003, the entire contents of which are hereby incorporated by reference.

BACKGROUND OF THE INVENTION

The present invention relates to an open/close mechanism for opening/closing an external member which forms part of a cabinet of an apparatus and which is pivotally supported on a predetermined pivot shaft for opening/closing relative to the apparatus, and to an image forming apparatus provided with the same.

A part of the cabinet of an image forming apparatus, such as a printer, facsimile apparatus and copying machine, is arranged to be capable of opening/closing relative to the apparatus body in order to facilitate an operation for settling any trouble, such as a paper jam, that occurs during the operation of the apparatus or an operation for maintenance.

Many of recently-developed image forming apparatus are of the type which is configured to perform image formation by transferring a developer to sheets and fixing of image by heating by means of a fixing device while feeding the sheets upwardly from the sheet feed section (paper feed section) located at a lower portion of the apparatus, in order to reduce the area to be occupied by the apparatus.

One such conventional image forming apparatus, as disclosed in Japanese Patent Laid-Open Publication No. 2000-191163, has an arrangement including a door member mounted laterally of the paper feed section for opening/closing by means of hinge, and a guide plate located inwardly of the door member for guiding sheets to be fed upwardly from the paper feed section, whereby the sheet feed path can be opened by opening the door member. This arrangement allows the sheet feed path to open and hence facilitates the jam settling operation or a like operation by merely opening the door member.

In response to recent requests for saving resources, image forming apparatus are often provided with the double-side printing function which enables image formation on both sides of a sheet as a recording medium.

Among image forming apparatus of the aforementioned type which performs image formation or a like operation while feeding sheets upwardly, there are many apparatus configured to achieve image formation on both sides of a sheet by changing the sheet feed direction to a generally horizontal direction after completion of image formation and heat-fixing of image on one side of the sheet and then switching back the sheet to a predetermined recirculation path. In this configuration, the recirculation path is located adjacent a portion of the cabinet on a lateral side of the image forming apparatus while the main part of the image forming section located inside the image forming apparatus with the paper feed section located below the image forming section.

Generally, such an image forming apparatus is so designed that the lateral-side contour line of the paper feed section coincides with the lateral-side contour line of a portion including the recirculation path in order to avoid the outward appearance of the apparatus becoming aesthetically poor due to an upper portion, including the fixing device and the recirculation path, protruding from the lateral-side contour line of the paper feed section located below the upper portion. This results in a relatively wide vacant space defined between the paper feed section and a portion of the cabinet situated on the lateral side of the paper feed section.

When the arrangement disclosed in Japanese Patent Laid-Open Publication No. 2000-191163 for example is to be applied to such an image forming apparatus as having a vacant space between the paper feed section and the portion of the cabinet situated on the lateral side of the paper feed section, inconvenience arises.

FIG. 7 is a schematic horizontal sectional view showing an open/close mechanism used in an image forming apparatus defining a certain vacant space 93 between a paper feed section 91 and an external member 92 located laterally of the paper feed section, the open/close mechanism including the external member 92 openably (pivotally) mounted and a sheet guide member 94 disposed inwardly of the external member 92.

As shown in FIG. 7A, because the sheet guide member 94 needs to be located deeply from the lateral-side external member 92 so as to position closely to the paper feed section 91, distance L2 from pivot shaft 95 of the lateral-side external member 92 to a distal end (pivoting end 94*a*) of the sheet guide member 94 which is situated farther from the pivot shaft 95 than the other end of the sheet guide member 94 is longer than distance L1 from the pivot shaft 95 to pivoting end 92*a* of the lateral-side external member 92 which is opposite from the pivot shaft 95. For this reason, if the sheet guide member 94 is formed integral with the lateral-side external member 92 inwardly of the lateral-side external member 92, the locus of the pivoting end 94*a* of the sheet guide member 94 passes outwardly of that of the pivoting end 92*a* of the lateral-side external member 92. Therefore, the pivoting end 94*a* of the sheet guide member 94 is caught on any other portion (front-side external member 96 in FIG. 7B) as shown in FIG. 7B, which results in a problem that the external member 92 cannot completely open. If the lateral-side external member 92 is made wider than the sheet guide member 94 (i.e. if the opening corresponding to the lateral-side external member 92 is made larger) in order to avoid this problem, useless space is enlarged with the increase in the width of the lateral-side external member 92 undesirably.

SUMMARY OF THE INVENTION

A feature of the present invention is to provide an open/close mechanism for an external member of an apparatus which is pivotally supported for opening/closing, wherein when an internal member required to be disposed at a deep location inwardly of the external member, such as a sheet guide member, is desired to cooperate with the opening/closing of the external member, it is possible to avoid the internal member being caught on any other portion without the need to enlarge the opening corresponding to the external member. Another feature of the present invention is to provide an image forming apparatus provided with the open/close mechanism.

To solve the above-described problem, an open/close mechanism according to the present invention comprises: a first pivot shaft mounted on a cabinet of an apparatus and supporting an external member for pivotal movement; and a second pivot shaft mounted within the apparatus at a location spaced a predetermined distance apart from the first pivot shaft inwardly of the apparatus and supporting an internal member for pivotal movement, the internal member being disposed opposite to the external member.

In addition, the open/close mechanism comprises a link member interlinking the external member and the internal member for causing the internal member to pivot about the second pivot shaft in cooperation with the external member pivoting about the first pivot shaft.

In this construction, the internal member has a pivoting end on the side opposite from the first pivot shaft, which pivoting end pivots not about the first pivot shaft but about the second pivot shaft.

Even in the case where the internal member needs to be disposed at a deep location inwardly of the external member, that is, where the distance between the first pivot shaft and the end of the internal member on the side opposite from the second pivot shaft is longer than the distance between the first pivot shaft and the end of the external member on the side opposite from the first pivot shaft when the external member is in its closed position, the locus of the pivoting end of the internal member fails to pass outwardly of the locus of the pivoting end of the external member. Thus, it is possible to avoid the internal member being caught on any other portion without the need to enlarge the opening of the cabinet, namely, the need to increase the width of the external member from the pivot shaft to the pivoting end.

The length of the link member is basically determined by the location of the internal member disposed as desired (i.e., the depth inside the apparatus) relative to the external member in the closed position. If the external member and the internal member are interlinked by means of the link member at their respective sides close to their respective pivoting ends, there arises a problem that the length of the link member limits the opening of the external member and, hence, the external member cannot sufficiently open. Such a problem can often be avoided if the external member and the internal member are interlinked by means of the link member at their respective sides close to their respective pivot shafts. In this case, however, a greater force will be needed to open/close the external member according to the principle of leverage.

In view of this problem, the link member may be configured to have a stretchable length between its connecting portions respectively connecting to the external member and the internal member. With this feature, when the external member is in the open position, the link member can have a stretched length longer than the length which the link member assumes when the external member is in the closed position. Thus, it becomes possible to solve the problem that the external member cannot sufficiently open due to the limitation imposed by the length of the link member.

The open/close mechanism may be conceived to have an arrangement wherein: the link member having a stretchable length between the connecting portions is provided with a resilient biasing member which resiliently biases the link member in such a direction as to stretch the length between the connecting portions respectively connecting to the external member and the internal member; and the internal member is positioned to abut a predetermined contact portion by the biasing force of the resilient biasing member when the external member is in its closed position. Such an arrangement is capable of positioning the internal member with high precision using the contact portion as a reference when the external member is in the closed position. Further, since the resiliently biasing force stretches the length of the link member between the connecting portions when the external member is open, it is possible to solve the aforementioned problem that the external member cannot sufficiently open.

The open/close mechanism may be provided with a storage section in a space defined between the external member and the internal member for storing a predetermined article. This arrangement enables effective utilization of space. Particularly when this arrangement is combined with the stretchable link member., the aforementioned space can advantageously be prevented from narrowing even when the external member opens.

According to one embodiment of the present invention, there is also provided an image forming apparatus provided with the above-described open/close mechanism. This image forming apparatus may have an arrangement in which the internal member constitutes a guide member for guiding a recording medium to record an image thereon, such as a recording sheet, under feeding. This arrangement allows the guide member to pivot in cooperation with the opening of the external member, thereby opening the recording medium feed path. Thus, the image forming apparatus facilitates operations for settling a paper jam and for maintenance. When the image forming apparatus is provided with the aforementioned storage section, the storage section may be configured to store, for example, parts to be used in a recording medium feed section for adjusting a recording medium size.

These and other features and attendant advantages of the present invention will become apparent from the following detailed description of the preferred embodiments to be read with reference to the accompanying drawings.

DETAILED DESCRIPTION OF THE PREFERRED EMBODIMENTS

Hereinafter, embodiments of the present invention will be described with reference to the accompanying drawings.

Figure 1:
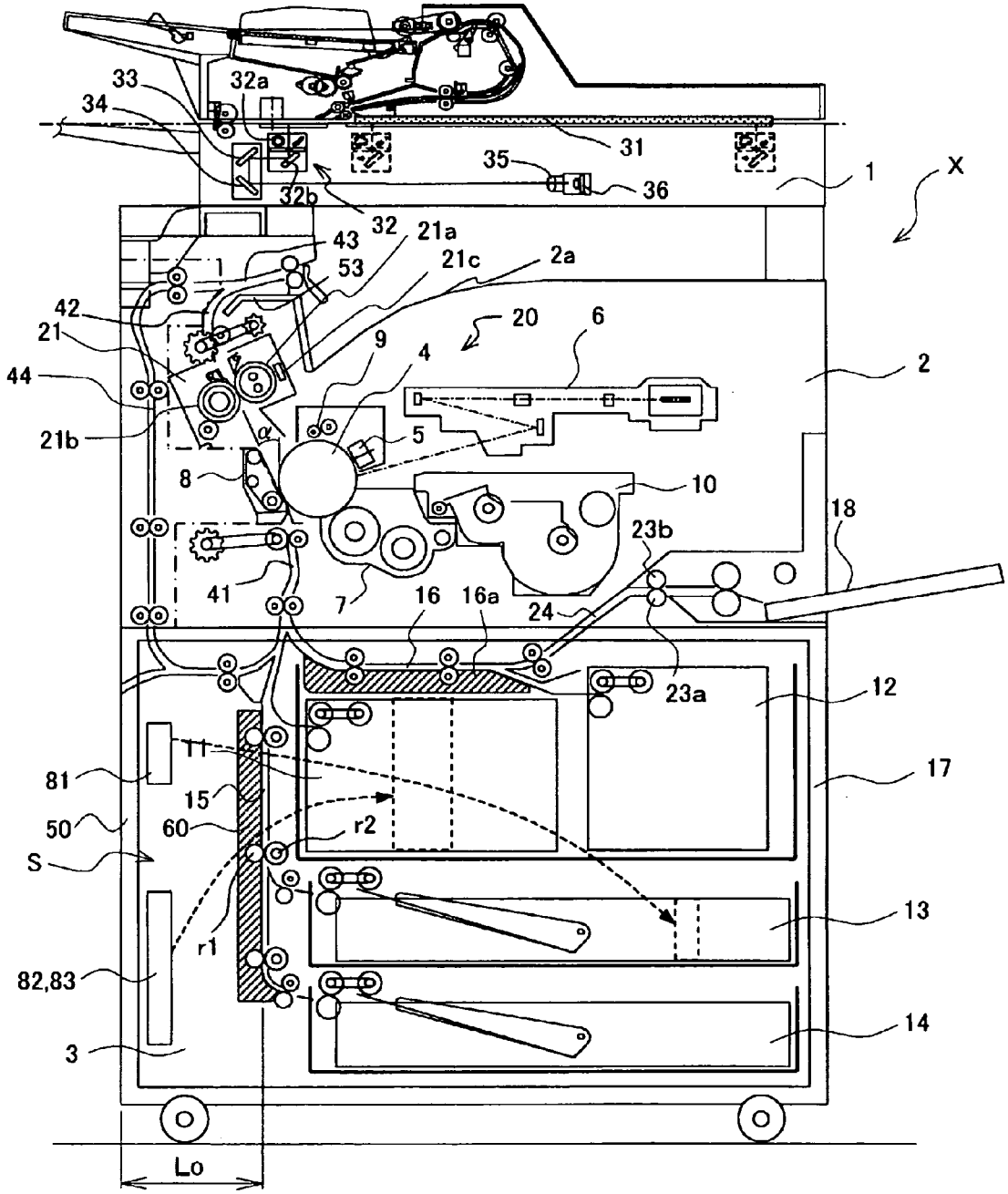
FIG. 1 is a schematic sectional view showing the construction of an image forming apparatus according to an embodiment of the present invention.

Referring first to FIG. 1, there is shown the construction of an image forming apparatus X according to one embodiment of the present invention.

The image forming apparatus X is a combined apparatus having both a copying function and a printer function. The image forming apparatus X has printing modes including a copier mode (copying mode), printer mode and FAX mode, any one of which is selected by a non-illustrated control section in response to an input made by manipulation through a non-illustrated manipulating section or a receipt of printing job transmitted from an external host device such as a personal computer.

As shown in FIG. 1, the image forming apparatus X is roughly divided into three sections: a document reading section 1 forming an uppermost section, a printer section 2 as an image forming section disposed below the document reading section 1, and a paper feed unit section 3 disposed further below.

When a start key on a control panel (not shown) disposed on a front-side portion of an apparatus cabinet is manipulated after inputting of data about the number of copies to be printed, printing magnification and the like through a condition input key on the control panel, the document reading section 1 starts a copying operation including reading of an image of a document placed on platen glass 31. Specifically, a copy lamp 32*a* of a copy lamp unit 32 is turned on and the copy lamp unit 32 starts exposing the document to light while moving horizontally. Light from the copy lamp 32*a* illuminating the document is turned into reflected light containing image information obtained from the document. The reflected light is inputted to CCD 36 via first mirror 32*b* of the copy lamp unit 32, second and third mirrors 33 and 34 and an optical lens 35, so that the image information contained therein is read.

The image information thus read, which is optical information, is converted into electric signals at a CCD circuit included in the non-illustrated control section. The image information signals are subjected to image processing under conditions established and then transmitted as print data to an optical scanning unit 6.

The printer section 2 includes an electrophotographic processing section 20 for forming image on a recording sheet as a recording medium using a developer, and a fixing unit 21 for heat-fixing the toner image on the recording sheet by pinching the recording sheet bearing the toner image between a fixing roller 21*a* and a pressure roller 21*b*. The fixing roller 21*a* incorporates a heater therein, which is supplied with electric power that is controlled by the non-illustrated control section so that a temperature detected by a temperature sensor 21*c* adapted to detect the temperature of the fixing roller 21*a* is maintained to a predetermined fixing temperature.

The electrophotographic processing section 20 is disposed generally centrally of the printer section 2 and includes photosensitive drum 4 and, around the photosensitive drum 4, electrostatic charger unit 5, optical scanning unit 6, developing unit 7, transfer unit 8 and cleaning unit 9.

The electrostatic charger unit 5 electrostatically charges the surface of photosensitive drum 4 uniformly. The optical scanning unit 6 scans the uniformly charged photosensitive drum 4 according to an optical image thereby to write an electrostatic latent image thereon. The developing unit 7 makes tangible the electrostatic latent image written by the optical scanning unit 6 according to print data.

The transfer unit 8 transfers the image recorded and reproduced on the photosensitive drum 4 to a recording sheet, while the cleaning unit 9 eliminates residual developer left on the photosensitive drum 4 thereby making the photosensitive drum 4 ready to record another image.

The residual developer eliminated by the cleaning unit 9 is collected into a developer supplying section 10 for recycling. The present invention is applicable not only to an image forming apparatus having such a residual developer recycling process but also to an image forming apparatus adapted to collect residual developer for disposal.

The paper feed unit section 3 includes paper feed trays 11 to 14 in each of which plural recording sheets are to be set. Thus, the paper feed unit section 3 is capable of holding various types of recording sheet, for example, separately in respective of the paper feed trays on a size basis.

The paper feed trays 11 and 12 are disposed side by side. The paper feed tray 13 is disposed under these trays 11 and 12 while the paper feed tray 14 disposed under the tray 13. In this embodiment, the paper feed trays 13 and 14 have substantially equal capacity, whereas the paper feed trays 11 and 12 are larger in capacity than the paper feed trays 13 and 14.

The paper feed unit section 3 has a first feed path 15 and a second feed path 16 for feeding the recording sheets held in each of the paper feed trays 11 to 14 toward the printer section 2. The first feed path 15 is adapted to feed the recording sheets held in each of the paper feed trays 11, 13 and 14 toward the printer section 2, while the second feed path 16 adapted to feed the recording sheets held in the paper feed tray 12 or a manual feed tray 18 flanking the apparatus body toward the printer section 2.

The first feed path 15 extends substantially vertically along a frame 17 of the paper feed unit section 3. On the other hand, the second feed path 16 extends substantially horizontally along the frame 17. In this way the paper feed trays 11 to 14 and the first and second feed paths 15 and 16 are disposed within the paper feed unit section 3 efficiently, thereby realizing space-saving for the paper feed unit section 3.

In setting recording sheets in each of the paper feed trays 11 to 14, an intended one of the paper feed trays 11 to 14 is drawn out in the direction in which the front face of the image forming apparatus X body is oriented, so as to be replenished with recording sheets.

Before image formation on a recording sheet in the image forming apparatus X, a suitable one is selected from the paper feed trays 1 to 14 and the manual feed tray 18 and the recording sheets held in the selected tray is fed one by one separately.

A recording sheet outgoing from any one of the paper feed trays 11 to 14 and the manual feed tray 18 is passed through the first or second feed path 15 or 16 and then passed upwardly through a third feed path 41 to between the photosensitive drum 4 and the transfer unit 8. In turn, the transfer unit 8 transfers an image recorded and reproduced on the photosensitive drum 4 to the recording sheet thus fed.

The recording sheet thus formed with the image is fed to the fixing unit 21 disposed further above, where the toner image is fixed by heating.

The recording sheet having undergone heat-fixing at the fixing unit 21 is fed into a fourth feed path 42 guiding the recording sheet further upwardly to a fifth feed path 43 disposed above the fixing unit 21.

The fifth feed path 43 changes the feeding direction to a substantially horizontal direction after the recording sheet bearing the heat-fixed image has passed through the fourth feed path so as to either eject the recording sheet to an ejected sheet tray 2*a* or a post-processing device (not shown) which are provided outside the apparatus or recirculate the recording sheet to a sixth feed path 44 by turning-back for the reverse side of the recording sheet to be formed with an image (double-side printing.)

As shown in FIG. 1, the sixth feed path 44, which is the recirculation path, is located adjacent a portion of the cabinet on a lateral side of the image forming apparatus X (on the left-hand side in FIG. 1 as viewed facing the figure.) The electrophotographic processing section 20, which plays the main part of image forming processing, is located inside the image forming apparatus X, while the paper feed unit section 3 located below the electrophotographic processing section 20.

The image forming apparatus X is so designed that the lateral-side contour line of the paper feed unit section 3 coincides with the lateral-side contour line of the sixth feed path 44 in order to avoid the outward appearance of the apparatus becoming aesthetically poor due to an upper portion, including the fixing unit 21 and the sixth feed path 44, protruding from the lateral-side contour line of the paper feed unit section 3 located below the upper portion. This results in a relatively wide vacant space S defined in the spacing Lo between sheet guide 60 forming part of the first feed path 15 extending along the paper feed unit section 3 and a portion of the cabinet extending along a lateral side of the sheet guide 60 (hereinafter will be referred to as "lateral-side cabinet 50".)

The lateral-side cabinet 50 of the image forming apparatus X is rendered openable/closable to facilitate operations including settling a paper jam in the first feed path when it occurs. Further, the sheet guide 60, which is a guide member forming a lateral side of the first feed path 15 and acting to guide recording sheets, is configured to open/close in cooperation with the lateral-side cabinet 50.

Figure 2:
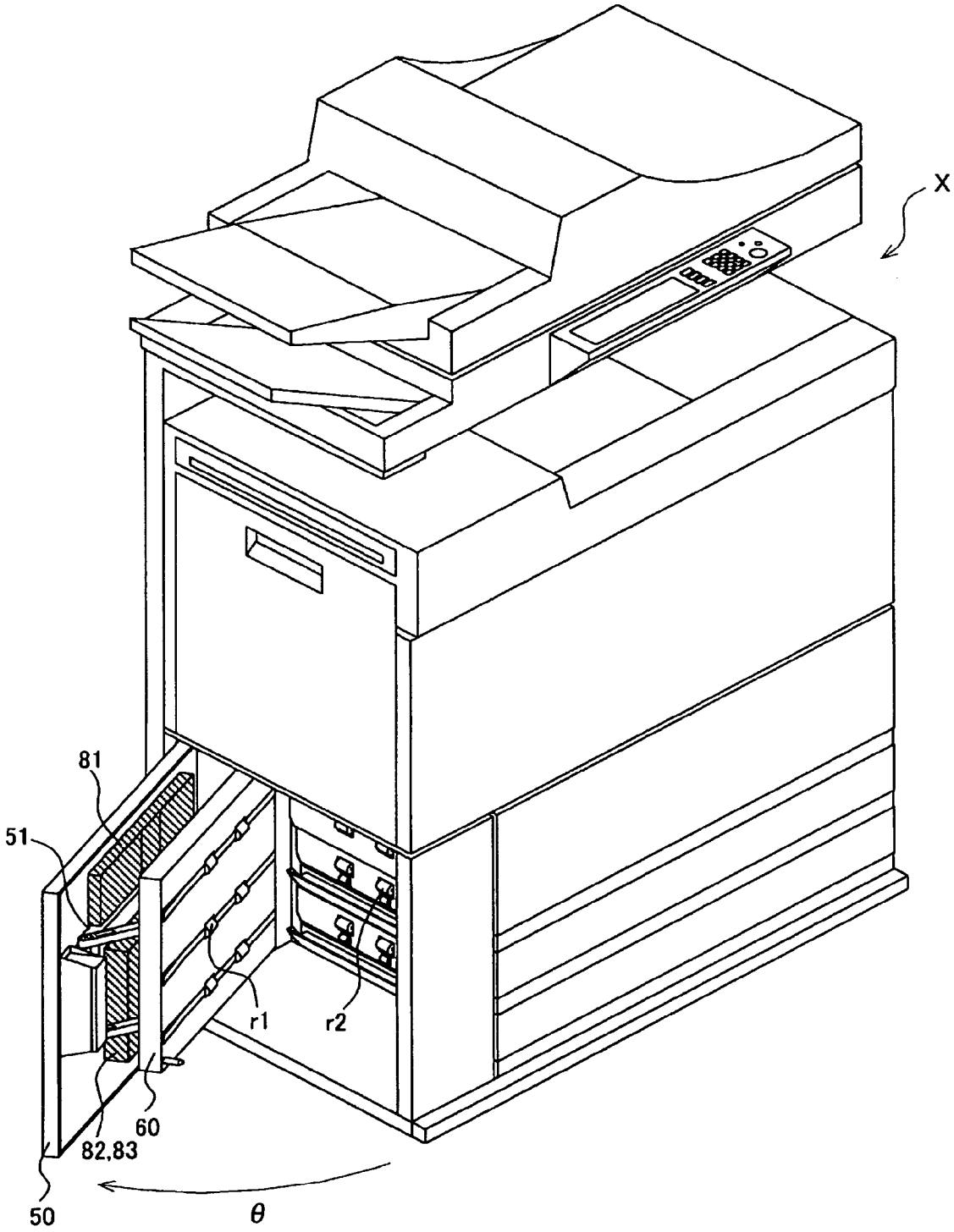
FIG. 2 is a perspective view of the image forming apparatus in a state where a lateral-side cabinet is open.

FIG. 2 is a perspective view of the image forming apparatus X in a state where the lateral-side cabinet 50 is open.

FIG. 3 is a schematic horizontal sectional view showing an arrangement of an open/close mechanism for the lateral-side cabinet 50.

Figure 3A:
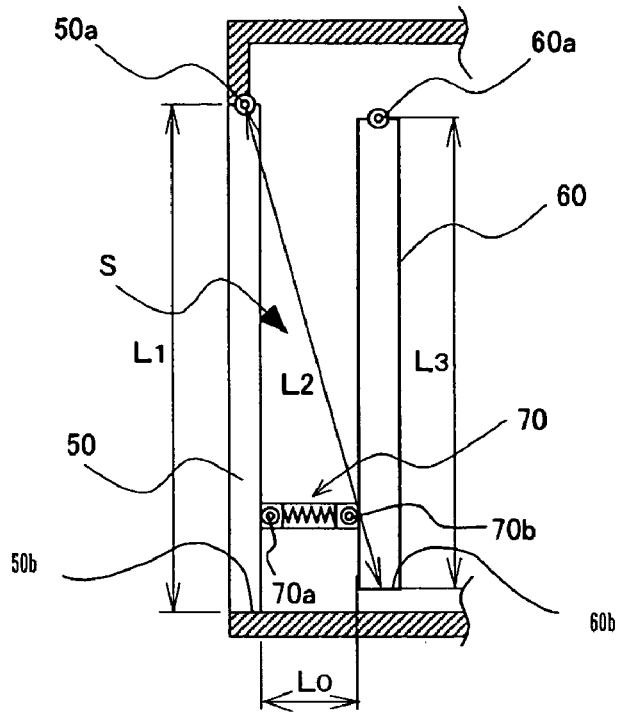
FIG. 3 is a schematic horizontal sectional view showing an arrangement of an open/close mechanism for the lateral-side cabinet of the image forming apparatus.

As shown in FIG. 3A, the lateral-side cabinet 50 forming part of the cabinet of the image forming apparatus X is pivotally supported on a first pivot shaft 50*a* so as to be openable/closable relative to the image forming apparatus X body.

The sheet guide member 60 is pivotally supported on a second pivot shaft 60*a* which spaced a predetermined distance apart from the first pivot shaft 50*a* inwardly of the image forming apparatus X.

A predetermined link member 70 has connecting portions 70*a* and 70*b* adjacent the opposite ends thereof which are pivotally connected to the lateral-side cabinet 50 and the sheet guide member 60, respectively. Thus, the lateral-side cabinet 50 and the sheet guide member 60 are interlinked by means of the link member 70 so that the sheet guide member 60 pivots in cooperation with the opening/closing of the lateral-side cabinet 50.

With the arrangement shown in FIG. 3, the sheet guide member 60, which is an internal member, has a pivoting end 60*b* (the end opposite from the pivot shaft 60*a*) which pivots not about the first pivot shaft 50*a* but about the second pivot shaft 60*a*.

Thus, there arises no inconvenience even when the sheet guide member 60 needs to be disposed inwardly of the lateral-side cabinet 50 at a deep location (about 200 mm deep for example.)

Figure 3B:
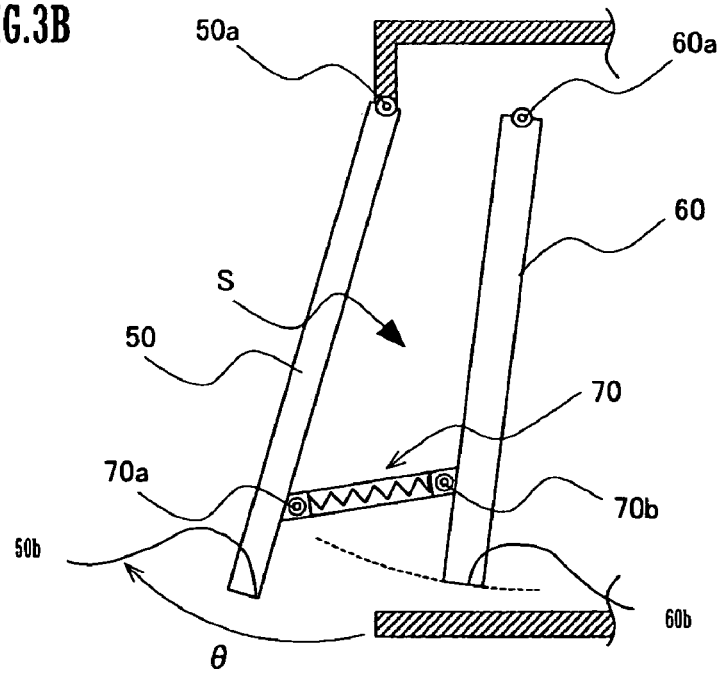

That is, even if the distance L2 between the first pivot shaft 50*a* and the pivoting end 60*b* of the sheet guide member 60 is longer than the distance L1 between the first pivot shaft 50*a* and the pivoting end 50*b* of the lateral-side cabinet 50 when the lateral-side cabinet 50 is in its closed position, the locus of the pivoting end 60*b* fails to pass outwardly of the locus of the pivoting end 50*b*, as shown in FIG. 3B. Thus, it is possible to avoid the sheet guide member 60 being caught on any other portion without the need to enlarge the opening of the cabinet, namely, the need to increase the width of the lateral-side cabinet 50 from the pivot shaft 50*a* to the pivoting end 50*b*.

FIG. 4 is a plan view of the aforementioned link member 70.

One connecting portion 70*b* of the link member 70 forms part of a movable member 71 which is slidable relative to and longitudinally of the body of link member 70. Thus, the link member 70 has a stretchable longitudinal length between the connecting portion 70*b* and the other connecting portion 70*a* forming part of the body of link member 70 (length between the connecting portions.)

Figure 4A:
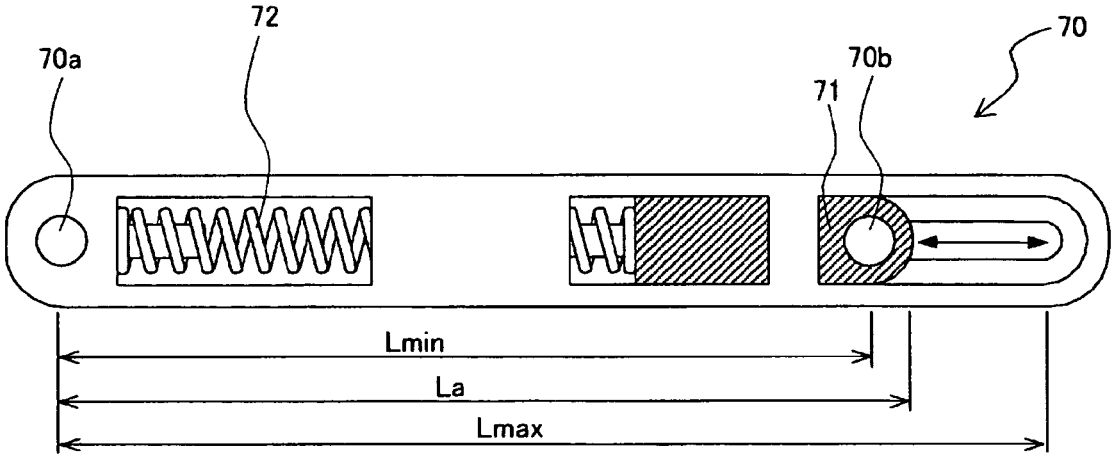
FIG. 4 is a plan view showing a link member used in the open/close mechanism for the lateral-side cabinet of the image forming apparatus.
Figure 4B:
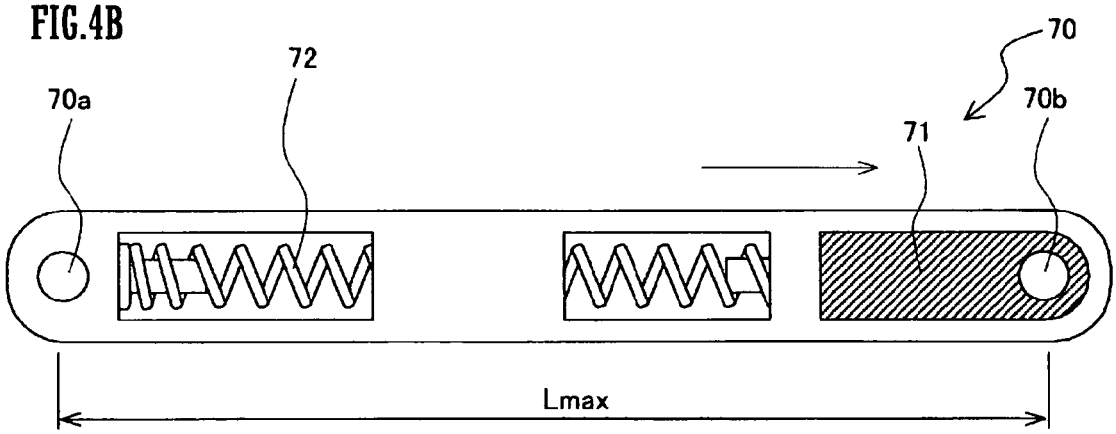

Further, the movable member 71 is resiliently biased with a resilient member 72 such as a helical compression spring in such a direction as to stretch the length between the connecting portions 70*a* and 70*b*. FIG. 4A shows a state where the length between the connecting portions 70*a* and 70*b* assumes the minimum, while FIG. 4B shows a state where the length between the connecting portions 70*a* and 70*b* assumes the maximum.

Here, the link member 70 is so configured that length Lmax, which is the maximum length between the connecting portions 70*a* and 70*b* as a result of the stretching of the length by the biasing force of the resilient member 72, is longer than length La (≈Lo), which is the length between the connecting portions 70*a* and 70*b* to be secured when the lateral-side cabinet 50 is in the closed position, while length Lmin, which is the minimum length between the connecting portions 70*a* and 70*b*, is shorter than length La.

With this feature, the resilient member 72 biases the sheet guide member 60 when the lateral-side cabinet 50 is in the closed position, so that roller r1 (see FIG. 2) mounted on the sheet guide member 60 abuts roller r2 mounted at the first feed path 15 on the paper feed unit section 3 side by the biasing force of the resilient member 72, thereby positioning the sheet guide member 60 with high precision. When the sheet guide member 60 is in the state thus positioned, the two rollers r1 and r2 form a roller pair which causes recording sheets to be fed through the first feed path 15 by its rotating force.

Further, this feature can prevent the occurrence of problems including a paper jam and a deviation in the image forming position due to a deviation in the position of a recording sheet under feeding, which are likely when the sheet guide member 60 is positioned with lowered precision.

On the other hand, when the lateral-side cabinet 50 is open, the biasing force of the resilient member 72 stretches the length between the connecting portions 70*a* and 70*b* of the link member 70 as shown in FIG. 3B, which prevents the occurrence of the inconvenience that the lateral-side cabinet 50 cannot sufficiently open due to a limitation imposed by the length between the connecting portions 70*a* and 70*b*. For example, the lateral-side cabinet 50 of the image forming apparatus X can open up to an open angle θ of about 45°.

In this embodiment, the resilient biasing member is not limited to the resilient biasing member 72 such as a helical compression spring formed of stainless steel wire or piano wire. Instead, a resilient biasing member of other type, such as a pneumatic biasing member using air or gas, may be used.

As shown in FIGS. 3A and 3B, the link member 70 having a stretchable length between the connecting portions makes it possible to secure at least a certain space between the lateral-side cabinet 50 and the sheet guide member 60

(hereinafter will be referred to as "open-close section space S") irrespective of whether the lateral-side cabinet 72 is open or closed.

The image forming apparatus X according to this embodiment is provided with a storage section in the aforementioned open-close section space S for effectively utilizing the space S.

Specifically, the image forming apparatus X is provided with storage shelves 51 on the inner side of the lateral-side cabinet 72, i.e., on the open-close space S side for storing parts to be used in the paper feed trays 11 and 13 for adjusting a sheet size. It has been a conventional practice to store such sheet size adjusting parts in storage spaces provided in respective paper feed trays 11 to 14 when the parts are not in use. The feature that the open-close section space S is utilized to store such parts allows space-saving to be made in the paper feed trays 11 and 13 and enables effective utilization of vacant space.

Figure 5:
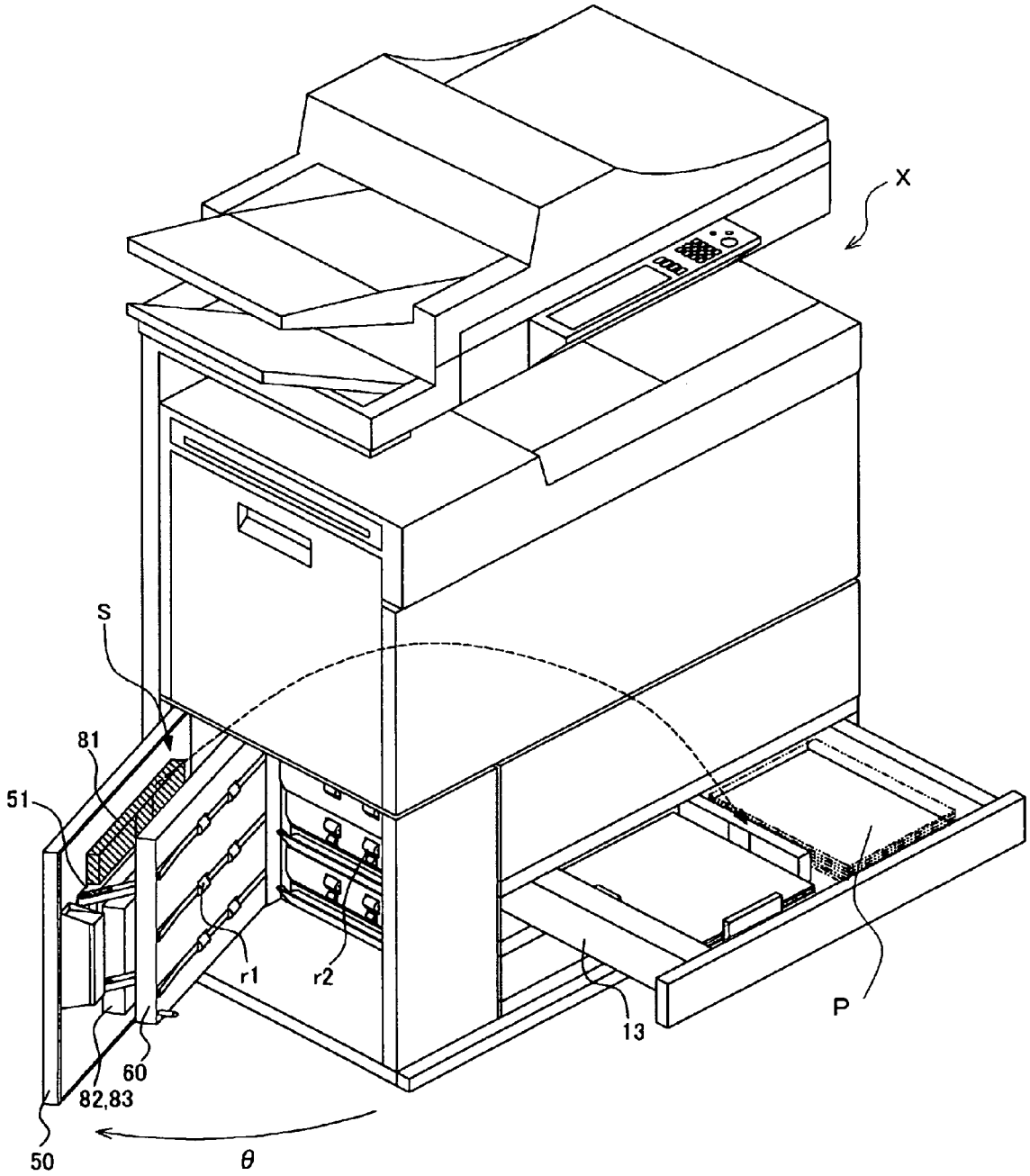
FIG. 5 is a perspective view of the image forming apparatus in a state where the lateral-side cabinet is open and a paper feed tray is drawn out.

FIG. 5 is a perspective view of the image forming apparatus X in a state where the paper feed tray 13 is drawn out.

As shown in FIG. 5, the image forming apparatus X stores a sheet rear edge guide 81 on the upper shelf of the storage shelves 51. The sheet rear edge guide 81 is used as fitted on the paper feed tray 13 when A4-size recording sheets are to be set in the paper feed tray 13.

Thus, there is no need to provide a storage space in the paper feed tray 13 for storing the rear edge guide 81 which becomes unnecessary when A3-size recording sheets are to be set in the paper feed tray 13. Therefore, the apparatus can be made compact or can use larger-size recording sheets even when the size of the apparatus remains the same. Further, when A4-size recording sheets are set in the paper feed tray 13, the remaining space in the paper feed tray 13 can be effectively utilized if reserve A4-size recording sheets P are stored therein.

Figure 6:
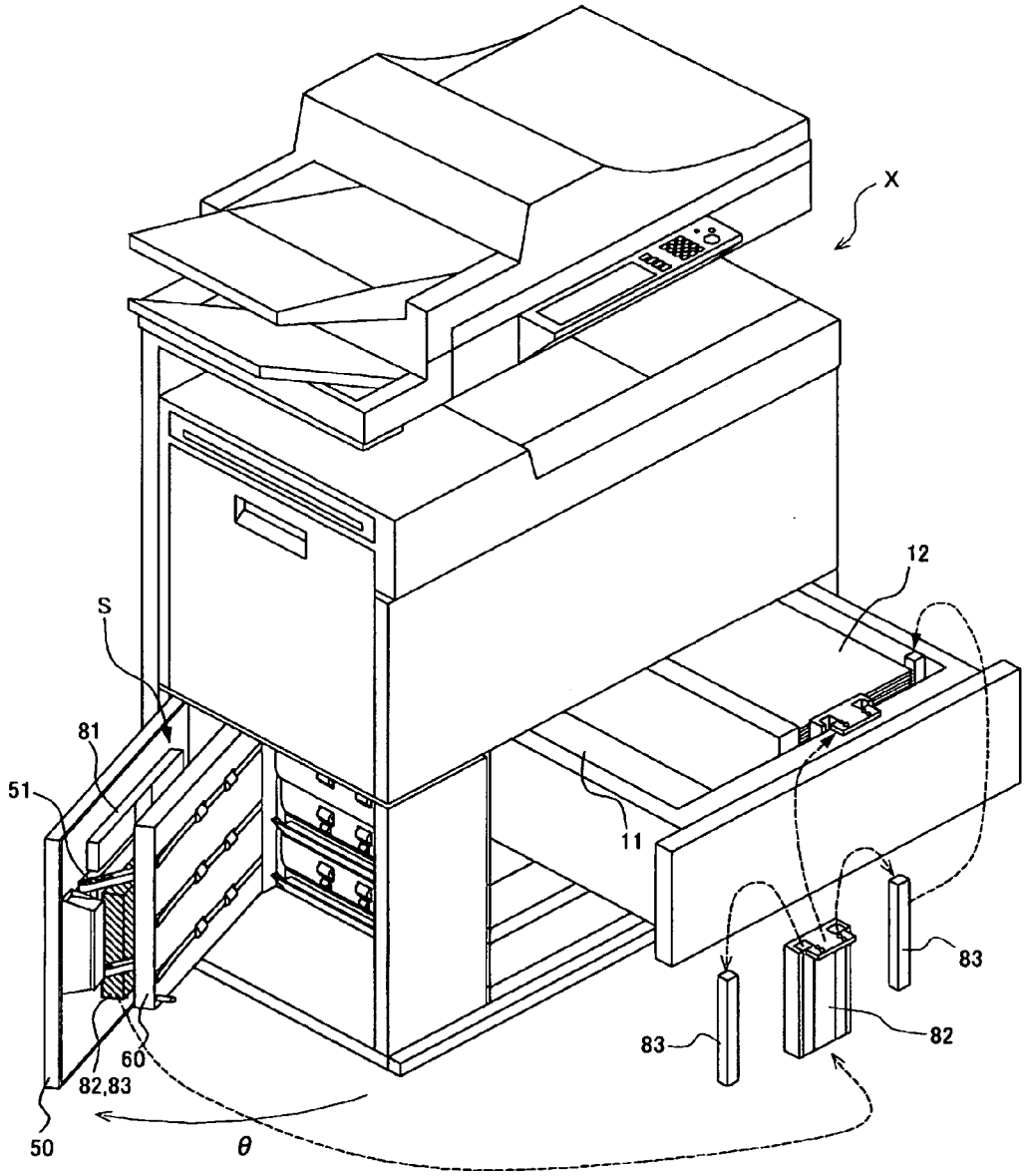
FIG. 6 is a perspective view of the image forming apparatus in a state where the lateral-side cabinet is open and paper feed trays are drawn out.
Figure 7A:
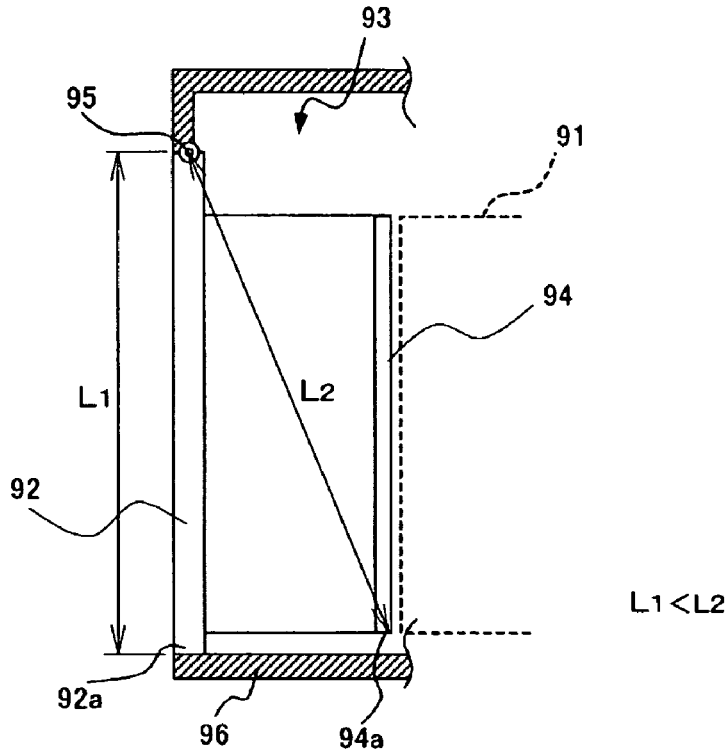
PRIOR ART FIG.7A
FIG. 7 is a schematic horizontal sectional view showing an open/close mechanism used in a conventional image forming apparatus, the open/close mechanism including an external member openably mounted laterally of a paper feed section and a sheet guide member disposed inwardly of the external member.
Figure 7B:
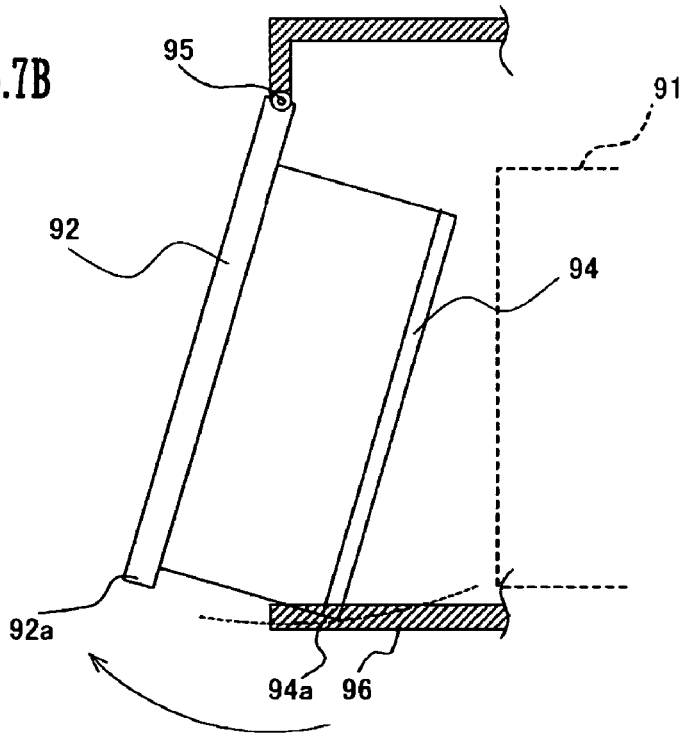

FIG. 6 is a perspective view of the image forming apparatus X in a state where the paper feed trays 11 and 12 are drawn out.

As shown in FIG. 6, the image forming apparatus X according to this embodiment stores a size guide 82 and a sheet rear edge guide 83 on the lower shelf of storage shelves 51. The size guide 82, which is positioned in accordance with the width of recording sheets, serves to guide edge portions of the recording sheets set in the paper feed tray 12, while the sheet rear edge guide 83 serves to guide the rear edge of the recording sheets set in the paper feed tray 12.

Thus, there is no need to provide a storage space in each of the paper feed trays 11 and 12 for storing the size guide 82 and the rear edge guide 83 when the guides are not in use. This case produces the same effect as the case shown in FIG. 5.

Sheet guides capable of changing the guiding position in accordance with the size of recording sheets to be set are classified into two types: guides of the movable type which is slidable in accordance with sheet sizes, and guides of the stationary-type to be fixed at positions corresponding to sheet sizes, such as the size guides 82 and rear edge guides 81 and 83.

Although the movable-type guides are convenient from the viewpoint that the guides do not require the operation of fixing them, the movable-type guides give rise to an inconvenience that when a large number of recording sheets are set in a paper feed tray, increased load imposed on the guide by the recording sheets is likely to move the guide. As is often the case with cassette-type paper feed trays capable of accommodating a large number of recording sheets, such as the paper feed trays 11 to 14, a lift-up mechanism is provided for lifting up recording sheets so as to maintain the positional relation between the sheets decreasing in number and the paper feed device such as paper feed rollers. Movement of such recording sheets caused by the lift-up mechanism, also, is likely to impose a heavy load on the sheet guide. For this reason, the movable-type guides are often used with paper feed trays of the type adapted to accommodate a relatively small number of recording sheets, such as the manual feed tray 18 (see FIG. 1), while on the other hand the stationary-type guides often used with paper feed trays of the cassette type adapted to accommodate a relatively large number of recording sheets.

In the case where such a stationary-type guide is used, effective utilization of space can advantageously made by utilizing the aforementioned vacant space S as a space for storing the stationary-type guide when the guide is not in use.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. An open/close mechanism for opening/closing an external member provided on a cabinet of an apparatus, comprising:

a first pivot shaft fixedly mounted on the cabinet and supporting the external member for pivotal movement;

a second pivot shaft fixedly mounted within the apparatus at a location spaced a predetermined distance apart from the first pivot shaft inwardly of the apparatus and supporting an internal member for pivotal movement, the internal member being disposed opposite to the external member; and a link member interlinking the external member and the internal member for causing the internal member to pivot about the second pivot shaft in cooperation with the external member pivoting about the first pivot shaft.

2. The open/close mechanism according to claim 1, wherein when the external member is in its closed position, the distance between the first pivot shaft and an end of the internal member on a side opposite from the second pivot shaft is longer than the distance between the first pivot shaft and an end of the external member on a side opposite from the first pivot shaft.

3. The open/close mechanism according to claim 1, wherein the link member has a stretchable length between its connecting portions respectively connecting to the external member and the internal member.

4. The open/close mechanism according to claim 3, wherein:

the link member is provided with a resilient biasing member which resiliently biases the link member in such a direction as to stretch the length between the connecting portions; and the internal member is positioned to abut a predetermined contact portion located within the apparatus by the biasing force of the resilient biasing member when the external member is in its closed position.

5. The open/close mechanism according to claim 1, wherein a storage section is provided in a space defined between the external member and the internal member for storing a predetermined article.

6. An image forming apparatus comprising an open/close mechanism for opening/closing an external member provided on a cabinet of an image forming apparatus body, wherein the open/close mechanism comprises:

a first pivot shaft fixedly mounted on the cabinet and supporting the external member for pivotal movement;

a second pivot shaft fixedly mounted within the image forming apparatus body at a location spaced a predetermined distance apart from the first pivot shaft inwardly of the image forming apparatus body and supporting an internal member for pivotal movement, the internal member being disposed opposite to the external member; and a link member interlinking the external member and the internal member for causing the internal member to pivot about the second pivot shaft in cooperation with the external member pivoting about the first pivot shaft.

7. The image forming apparatus according to claim 6, wherein when the external member is in its closed position, the distance between the first pivot shaft and an end of the internal member on a side opposite from the second pivot shaft is longer than the distance between the first pivot shaft and an end of the external member on a side opposite from the first pivot shaft.

8. The image forming apparatus according to claim 6, wherein the link member has a stretchable length between its connecting portions respectively connecting to the external member and the internal member.

9. The image forming apparatus according to claim 8, wherein:

the link member is provided with a resilient biasing member which resiliently biases the link member in such a direction as to stretch the length between the connecting portions; and the internal member is positioned to abut a predetermined contact portion located within the image forming apparatus body by the biasing force of the resilient biasing member when the external member is in its closed position.

10. The image forming apparatus according to claim 6, wherein a storage section is provided in a space defined between the external member and the internal member for storing a predetermined article.

11. The image forming apparatus according to claim 6, wherein the internal member constitutes a guide member for guiding a recording medium to record an image thereon under feeding.

12. The image forming apparatus according to claim 10, wherein the storage section is configured to store parts to be used in a recording medium feed section for adjusting a recording medium size.

* * * * *